United States Patent [19]

Westerman

[11] Patent Number: 4,559,541

[45] Date of Patent: Dec. 17, 1985

[54] LOG-PERIODIC LEAKY TRANSMISSION LINE ANTENNA

[75] Inventor: Charles W. Westerman, El Toro, Calif.

[73] Assignee: Ford Aerospace & Communications Corporation, Detroit, Mich.

[21] Appl. No.: 524,637

[22] Filed: Aug. 19, 1983

[51] Int. Cl.[4] ..... H01Q 11/10

[52] U.S. Cl. ..... 343/792.5

[58] Field of Search ..... 343/792.5, 700 MS, 846, 343/866, 829, 867, 905

[56] References Cited

U.S. PATENT DOCUMENTS

| | | | |
|---|---|---|---|
| 2,977,597 | 3/1961 | Du Hamel et al. | 343/792.5 |
| 3,101,474 | 8/1963 | Wickersham, Jr. et al. | 343/792.5 |
| 3,123,827 | 3/1964 | Arnold et al. | 343/792.5 |
| 3,210,768 | 10/1965 | Hudock et al. | 343/792.5 |
| 3,221,330 | 11/1965 | Berry | 343/792.5 |
| 3,308,470 | 3/1967 | Bell | 343/792.5 |
| 3,355,740 | 11/1967 | Mayes | 343/792.5 |
| 3,509,572 | 4/1970 | Barbano | 343/792.5 |
| 4,286,271 | 8/1981 | Barbano et al. | 343/792.5 |
| 4,445,122 | 4/1984 | Pues | 343/700 MS |

FOREIGN PATENT DOCUMENTS

| | | | |
|---|---|---|---|
| 128902 | 10/1980 | Japan | 343/846 |

*Primary Examiner*—Eli Lieberman
*Assistant Examiner*—Michael C. Wimer
*Attorney, Agent, or Firm*—Edward J. Radlo; Robert D. Sanborn

[57] ABSTRACT

A compact, low-profile broad-banded log-periodic antenna comprises a planar conductor (3) partially sandwiched by but electrically insulated from two substantially parallel spaced-apart ground planes (4, 8). The sandwich extends as far as an imaginary plane (15) that is orthogonal to conductor (3) and to the ground planes (4, 8). Conductor (3) comprises an alternating series of radiating loops (L(n)) and non-radiating transmission-line loops (L(j)). The non-radiating loops (L(j)'s) lie on the ground plane (4, 8) side of plane (15). The radiating loops (L(n)'s) lie on the other side of plane (15). Optional additional ground planes (6, 10) may be employed, in which case they lie in plane (15) and meet one of the primary ground planes (4 or 8, respectively) along a common edge. The length (d) of the loops (radiating or non-radiating), the spacing (D) between loops, and the height (h) and width (w) of the radiating loops (L(n)) are all scaled by a factor (S) which is less than 1 but greater than 0. The top members (B(n)) of the radiating loops (L(n)) converge towards a point P which defines the preferable termination point of the optional ground planes (6, 10).

7 Claims, 5 Drawing Figures

E-PLANE
PATTERN

H-PLANE
PATTERN

LOG-PERIODIC LEAKY TRANSMISSION LINE ANTENNA

DESCRIPTION

1. Technical Field

This invention pertains to the field of log-periodic antennas for radiating and receiving electromagnetic energy.

2. Background Art

U.S. Pat. No. 3,101,474 shows an antenna having conductive radiating plates orthogonal to and in electrical contact with a conductive ground plane;

U.S. Pat. No. 3,210,768 discloses an antenna having zig-zag conductors having protruding stubs, in a plane forming an acute angle with a conductive ground plane; and no looping transmission line;

U.S. Pat. No. 4,286,271 shows an antenna having two sets of zig-zag loops suspended above a conducting ground plane; it does not show a transmission line sandwiched between two ground planes;

U.S. Pat. No. 3,221,330 discloses an antenna having a center boom and resonant elements;

U.S. Pat. No. 2,977,597 shows an antenna having a center boom; it does not disclose two ground planes sandwiching a transmission line;

U.S. Pat. No. 3,355,740 discloses an antenna having horizontally polarized radiating elements positioned above a ground plane and forming an acute angle therewith; and U.S. Pat. No. 3,123,827 shows an antenna having radiating loops electrically connected to a ground plane, and a transmission line on the same side of the ground plane as the radiating loops.

None of the above patents discloses the novel features of the present invention: a log-periodic antenna having a conductive planar non-radiating transmission line portion (L(j)'s, where j is odd) that is sandwiched between, but electrically insulated from, two substantially parallel conductive ground planes (4, 8); and a conductive planar radiating portion (L(n)'s, where n is even) which is co-planar with the non-radiating portion, protrudes from the sandwich comprising the substantially parallel ground planes (4, 8) and the non-radiating portion, and is electrically insulated from the ground planes (4, 8).

DISCLOSURE OF INVENTION

The present invention is an antenna which radiates a unidirectional beam having extremely broad bandwidth. The antenna is simple in design and compact in size. A planar antenna, it can be readily and easily fabricated with a high degree of reproducibility using printed circuit techniques. In the case where the antenna is mounted on a surface, such as a conductive ground plane (6, 10), the antenna protrudes just slightly from said surface (and imbeds slightly therewithin).

The antenna comprises one continuous planar conductor (3) consisting of an alternating series of radiating loops (L(n), where n is an even integer) and non-radiating transmission line loops (L(j), where j is an odd integer). The loops L(k) (k is used throughout this specification to denote any non-negative integer) monotonically decrease in size in the direction of radiation (emanating from the antenna when in transmitting mode, entering the antenna when in receiving mode).

The radiating loops (L(n)) are exposed and free to radiate, while the non-radiating loops (L(j)) are sandwiched between two substantially parallel conductive ground planes (4, 8) to form a transmission line. The characteristic impedance of the conductor (3) is kept as constant as possible throughout all the radiating loops (L(n)) and non-radiating loops (L(j)). Thus, a wave of electromagnetic energy launched at the small-looped end of the conductor (3) encounters no impedance mismatches as it passes repeatedly across the transition boundaries separating adjacent radiating loops (L(n)) and non-radiating loops (L(j)).

The phase progression along the conductor (3) is that of a uniform transmission line, and more importantly, that of a log-periodic zig zag antenna far removed from a conductive ground plane.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF THE PREFERRED EMBODIMENTS

Figure 2:
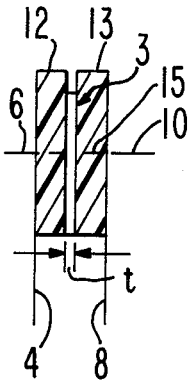
FIG. 2 is an end view of the antenna depicted in FIG. 1.
Figure 1:
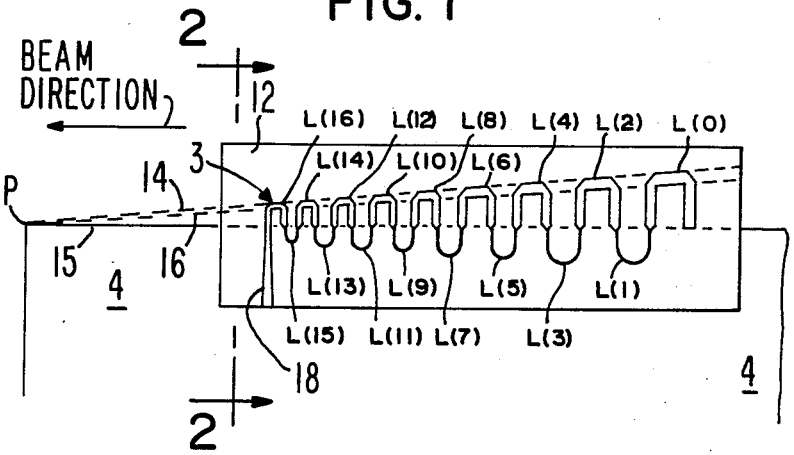
FIG. 1 is a trace of a side view of an antenna of the present invention covering the frequency band 5 GHz to 8 GHz, drawn to scale, in which the front ground plane (8) and front dielectric (13) have been removed for clarity.

The log-periodic antenna of the present invention comprises a planar conductor 3, which can be a metal trace on a planar dielectric circuit board element 12 or 13 (see FIG. 1). Conductor 3 has a small but finite thickness t (see FIG. 2). Conductor 3 is sandwiched between, substantially parallel to, and electrically insulated from, two substantially parallel spaced-apart electrically conductive ground planes 4, 8. Preferably, at all points along conductor 3, conductor 3 is equidistant from ground planes 4 and 8. Conductor 3 is retained in spaced, substantially parallel relation with respect to ground planes 4 and 8 by means of dielectric spacers 12, 13. Conductor 3 is in the illustrated embodiment an etched pattern on either dielectric spacer, 12 or 13.

Conductor 3 comprises an alternating, continuous series of radiating loops L(n) and non-radiating transmission line loops L(j). The loops L(k) decrease in size monotonically by a scale factor S in the direction of radiation emanating from the antenna (when it is transmitting). The radiating loops L(n) lie on one side (above in FIGS. 1 and 2) of an imaginary plane 15, and the non-radiating loops L(j) lie on the other side of plane 15. The upper edges of ground planes 4 and 8 are coincident with plane 15. Plane 15 is orthogonal to ground planes 4 and 8 and to conductor 3.

Ground planes 6 and 10 are optional. When they are used, both are present and each is an electrical conductor lying in plane 15 and meeting one of the primary ground planes 4, 8 along a common edge, preserving the dielectric gap between each ground plane structure (6, 4 and 10, 8) and conductor 3.

The total number of loops L(k) is designated as m+1, as they are numbered from 0 through m, corresponding to the largest loop through the smallest loop. The greater the number of loops m+1, the greater the bandwidth of the antenna. Radiation and reception at a particular frequency occurs within a region of the antenna known as the active region for that frequency, consisting of several loops L(k) (the antenna does not resonate at any frequency). Normally, the minimum number of radiating loops L(n) comprising an active region is at least 3. The antenna must have enough loops m+1 to encompass an active region for each desired frequency of operation. As the frequency increases, the sizes of the loops L(k) constituting an active region for that frequency decrease. In the illustrated embodiment, 17 loops were employed.

An important design goal is that the characteristic impedance of conductor 3 be as constant as possible at all points thereon, to avoid the problem of reflected waves. Particular care must be taken to maintain constancy in characteristic impedance as conductor 3 transitions from a radiating loop L(n) to a non-radiating loop L(j), or vice-versa.

The characteristic impedance of the radiating loops L(n) is kept constant (at approximately 100 ohms in the illustrated embodiment) by maintaining the conductor 3 width w and height h in the same proportion to each other at all points along the conductor 3. Thus, the ratio of instantaneous inductance to instantaneous capacitance (which determines characteristic impedance) is constant throughout the conductor 3. The characteristic impedance of the non-radiating loops L(j) is kept constant at 100 ohms to match that of the radiating loops L(n); this is accomplished by holding the non-radiating loop width (i.e., the dimension orthogonal to the thickness t) constant. The actual width of the non-radiating loops L(j) depends upon the spacing between ground planes 4, 8 and the electrical properties of dielectric material 12, 13.

The scale factor S is arbitrary within the theoretical range of $0<S<1$; as a practical matter, S is greater than or equal to 0.8. For the illustrated embodiment, $S=0.9417$. If S decreases, the overall length of conductor 3 decreases and the beam radiated by the antenna becomes broader in both the E-plane and the H-plane.

Conductor 3 further comprises an input transmission line member 18, which is preferably coupled to the smallest radiating loop L(m). Input transmission line member 18 is shown to be tapered in FIG. 1, so that the conductor 3 characteristic impedance will be smoothly transformed to that of an input connector (not illustrated) coupled to the lower end of transmission line member 18. In the embodiment illustrated, the characteristic impedance of the input connector was 50 ohms.

Figure 3:
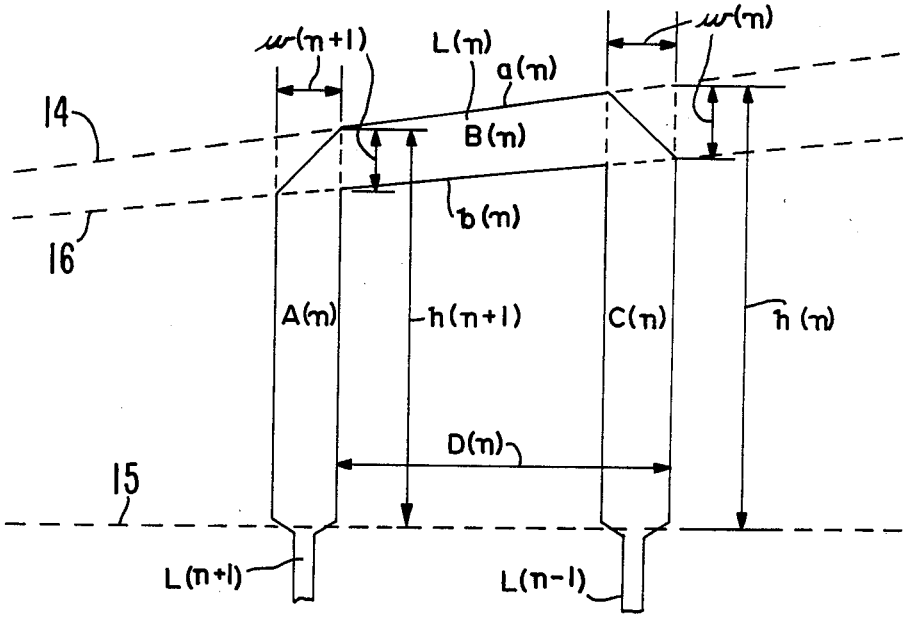
FIG. 3 is a detailed sketch of an arbitrary radiating loop L(n), that is neither the smallest loop (L(m)) nor the largest loop (L(0)), of the antenna of the present invention.

As shown in FIG. 3, each radiating loop L(n) has a first vertical member A(n), a slightly longer second vertical member C(n), and an almost horizontal top member B(n) connecting A(n) and C(n) at ends thereof. Each B(n) has an upper edge a(n) and a lower edge b(n). All the a(n)'s are colinear along an imaginary line 14 and all the b(n)'s are colinear along an imaginary line 16. Lines 14 and 16 converge at point P, which is situated in plane 15. Preferably, optional ground planes 6 and 10 extend (in the beam direction) as far as point P, but no further. This restriction allows the diffraction effects (which control the antenna beam direction) to be frequency independent.

Strict adherance to the principles of log periodic antenna design requires that all dimensions, including conductor thickness t and the spacing s between ground planes 4, 8, be scaled by the scale factor S. However, because of the convenience of using printed circuit board construction, both thickness t and spacing s were kept constant in the illustrated embodiment. This did not prove to be a problem, since t was less than one tenth the width of conductor 3, even for the smallest loop L(16). For highly critical applications, thickness t and spacing s could also be scaled by the scaling factor S.

As illustrated in FIG. 3, the edges of each A(n) and C(n) connecting with non-radiating loops (L(n+1) and L(n−1)) were chamfered by 30° to minimize the step capacitance and thus maintain a constant characteristic impedance at each transition with a non-radiating loop L(n+1) and L(n−1).

The width of each C(n) is w(n). The width of each A(n) is w(n+1). $w(k)=w(0)S^k$ for all integers k such that $0\leqq k\leqq m+1$. The width of each B(n) at its junction with each C(n) is w(n) and the width of each B(n) at its junction with each A(n) is w(n+1).

The height of each C(n) is h(n). The height of each A(n) is h(n+1). In each case, the heights h are measured at the right-hand side of the corresponding vertical member A(n) or C(n). $h(k)=h(0)S^k$ for all integers k such that $0\leqq k\leqq m+1$.

The distance between each A(n) and C(n) is denoted as D(n) and is measured between the right-hand edges of the vertical members A(n), C(n). $D(k)=D(0)S^k$ for all integers k such that $0\leqq k\leqq m$.

The shape of each non-radiating loop L(j) is not critical, but the length d of each loop L(k) (radiating or non-radiating) is similarly scaled by the factor S. Thus, $d(k)=d(0)S^k$ for all integers k such that $0\leqq k\leqq m$.

The relationship between the D's and the h's is: $2D(0)+2h(0)=W(MAX)/2$, where W(MAX) is the longest wavelength capable of being radiated by the antenna. This formula is used to select the parameters of the antenna as follows. W(MAX) is first selected based upon the desired lowest frequency of operation of the antenna. Then the ratio h(0)/D(0) is arbitrarily selected within a suitable range, such as $0.5<h(0)/D(0)<2$, and h(0) and D(0) are thus determined. Then w(0) is selected to be approximately equal to be between one-third and one-fifth of h(0). Then the characteristic impedance Z of conductor 3 is selected to be approximately 100 ohms, based upon the characteristic impedance of a long wire in free space. Then the spacing s between ground planes 4, 8 is selected to be a small value compared with the wavelength corresponding to the highest desired operating frequency of the antenna. Finally, the width of the L(j)'s is selected based upon known relationships between impedance, ground plane spacing, and conductor width for stripline conductors, taking into account the dielectric constants of dielectrics 12 and 13.

As discussed earlier, for many applications spacing s can be kept constant for all L(j)'s . In this case, ground planes 4, 8 are parallel. If, however, s is made to scale by S, ground planes 4, 8 would if extended converge at point P (and along a line orthogonically intersecting plane 15 at point P). In either case, it is not necessary to extend ground planes 4, 8 more than four conductor widths (w(m+1) and w(0), respectively) beyond conductor 3 in either the beam direction or counter-beam direction. At or beyond these distances away from conductor 3, ground planes 4, 8 can be connected by electrically conductive end plates located on the same side of plane 15 as ground planes 4, 8, to form a box around the non-radiating portion of conductor 3.

Figure 4:
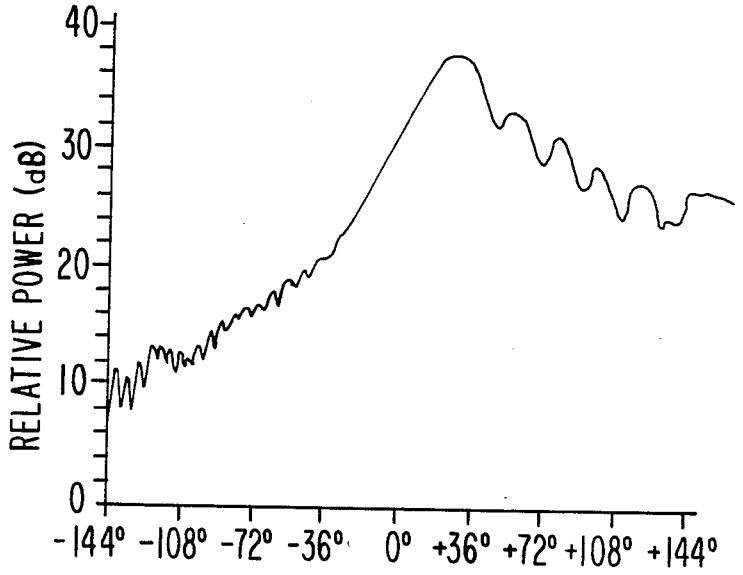
FIG. 4 is a measured farfield E-plane pattern of the antenna of FIG. 1 operating at a frequency of 6 GHz.
Figure 5:
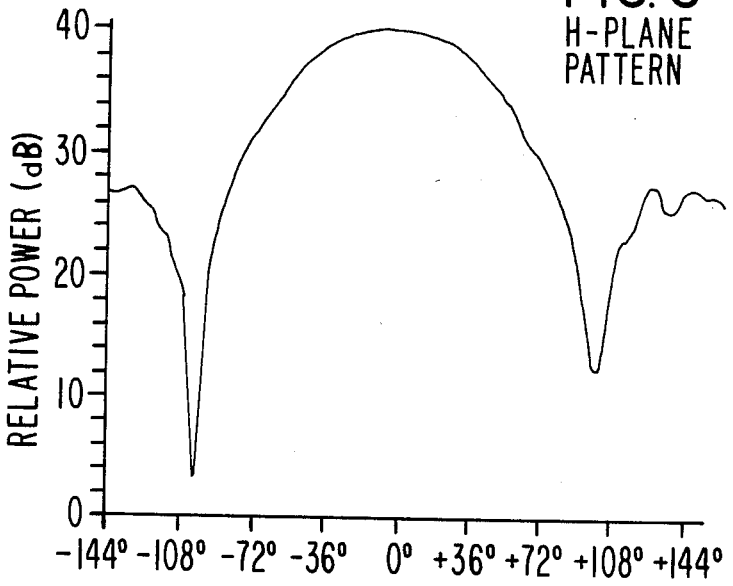
FIG. 5 is a measured farfield H-plane pattern of the antenna of FIG. 1 operating at a frequency of 6 GHz.

FIGS. 4 and 5 show the excellent results obtained with the illustrated embodiment. The far-field E-plane pattern of FIG. 4 was measured in the plane of conductor 3. The far-field H-plane pattern of FIG. 5 was measured in plane 15 and shows that the 3 dB bandwidth was 89°.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A log-periodic antenna comprising:

a planar, electrically conductive non-radiating portion substantially parallel to, sandwiched between, and electrically insulating from two substantially parallel electrically conductive primary ground planes; and a planar, electrically conductive radiating portion coplanar and contiguous with the non-radiating portion, protruding from the sandwich comprising the two primary ground planes and the non-radiating portion, and electrically insulated from the two primary ground planes;

wherein the radiating and non-radiating portions comprise one continuous conductor having alternating radiating and non-radiating loops, wherein the loop sizes decrease monotonically in the direction of radiation emanation, and the width of each non-radiating loop is less than the width of each contiguous radiating loop.

2. The antenna of claim 1 further comprising two additional electrically conductive ground planes lying in a common plane, each additional ground plane being orthogonal to the sandwich and meeting one of the primary ground planes along a common edge;

wherein the non-radiating portion extends orthogonally from one side of the common plane of the additional ground planes, and the radiating portion extends orthogonally from the other side of said common plane.

3. The antenna of claim 1 wherein the characteristic impedance of the continuous conductor is substantially constant at all points thereon.

4. The antenna of claim 1 wherein each radiating loop comprises a first vertical member having a height of $h(n+1)$, a second vertical member having a height of $h(n)$, and an almost horizontal top member connecting the two vertical members and having a length of $D(n)$; where $n$ is an even integer such that $0 \leqq n \leqq m$;

$m+1$ is the total number of loops in the conductor;

$k$ is a non-negative integer;

$h(k)=h(0)S^k$ for all $k$ such that $0 \leqq k \leqq m+1$;

$D(n)=D(0)S^k$ for all $n$ such that $0 \leqq n \leqq m$;

$S$ is a scale factor such that $0<S<1$;

$h(0)$ is the height of the second vertical member of the largest radiating loop;

$2D(0)+2h(0)=W(MAX)/2$; and $W(MAX)$ is the maximum wavelength that can be radiated by the antenna.

5. The antenna of claim 4 wherein the width of the first vertical member is $w(n+1)$, the width of the second vertical member is $w(n)$, and the top member has a relatively thick end connected to the second vertical member and having a width of $w(n)$, and a relatively thin end connected to the first vertical member and having a width of $w(n+1)$; where $w(k)=w(0)S^k$ for all $k$ such that $0 \leqq k \leqq m+1$; and $w(0)$ is the width of the second vertical member of the largest radiating loop.

6. The antenna of claim 4 wherein $0.8 \leqq S<1$.

7. The antenna of claim 2 wherein each top member has an upper edge and a lower edge, all the upper edges being colinear along a first line, and all the lower edges being colinear along a second line which intersects the first line at an end point;

wherein the end point defines the maximum distance that the additional ground planes extend from the radiating portion in the direction of radiation emanation.

* * * * *